United States Patent [19]

Sutherland

[11] 4,045,107

[45] Aug. 30, 1977

[54] MULTI-CONTACT CONNECTORS WITH IDENTICAL CONTACTS

[75] Inventor: Byron Sutherland, Pearland, Tex.

[73] Assignee: Walker-Hall-Sears, Inc., Houston, Tex.

[21] Appl. No.: 759,686

[22] Filed: Nov. 26, 1976

Related U.S. Application Data

[63] Continuation of Ser. No. 606,902, Aug. 22, 1975, abandoned.

[51] Int. Cl.[2] ..... H01R 25/00

[52] U.S. Cl. ..... 339/48; 339/49 B; 339/61 M

[58] Field of Search ..... 339/47–49, 339/59 M, 61 M, 244 R, 61 R

[56] References Cited

U.S. PATENT DOCUMENTS

| | | | |
|---|---|---|---|
| 904,603 | 11/1908 | Crocker | 339/47 R |
| 3,080,544 | 3/1963 | Stott | 339/48 |
| 3,148,929 | 9/1964 | Gordon | 339/49 R |
| 3,440,596 | 4/1969 | Frompovicz | 339/49 R |
| 3,576,516 | 4/1971 | Mull | 339/244 R |

*Primary Examiner*—Roy Lake
*Assistant Examiner*—Mark S. Bicks
*Attorney, Agent, or Firm*—Michael P. Breston

[57] ABSTRACT

The electric multi-contact connector comprises a pair of plugs, each carrying a plurality of elongated contact members mounted in spaced-apart relationship on an insulating base. Each contact has an unbiased prong-end for mating with an opposite unbiased prong end, and an opposite terminal-end for connection to an electric conductor. The prong-ends of the contacts of both plugs are preferably substantially identical in shape. The base is preferably made at least in part of a resilient material, or the contacts are otherwise resiliently mounted on the base. When the plugs are moved into mating engagement, each pair of mating prong-ends forms an abutting pressure contact establishing a mechanical and electrical connection between the two conductors connected to the terminal-ends of the engaged pair of contacts.

2 Claims, 19 Drawing Figures

MULTI-CONTACT CONNECTORS WITH IDENTICAL CONTACTS

This is a continuation of application Ser. No. 606,902, filed Aug. 22, 1975, now abandoned.

BACKGROUND OF THE INVENTION

1. Field of the Invention a. This invention generally relates to multi-contact connectors.

b. More specifically, the invention relates to multi-contact spread connectors for seismic cables.

2. Description of the Prior Art

Multi-contact connectors are widely used in various technical fields. While this invention is not limited to the seismic prospecting field, it will be described as having particular utility thereto. In the seismic art, multi-contact connectors are known as "spread" connectors which are adatped for interconnecting the electric conductors of geophone spread cables. Each electric conductor carries the signal from one or more geophones; the signal provides a seismic trace on a suitable recorder. A faulty pair of contacts in any one of the spread connectors will cause the complete loss of the signal and hence loss of the corresponding seismic trace.

Since geophysical work is carried out in tough terrains, the spread connector typically becomes subjected to dirt, sand, water, mud, etc. Even though the contacts are usually mounted in waterproof housings, the contacts unavoidably become dirty requiring frequent cleaning thereof.

Most commercially available spread connectors employ pin and socket terminals. While the pins because of their convex surfaces are relatively easy to clean, dirt deposited inside the sockets is rather difficult to dislodge. Normally, mechanical contact is established between the outer wall of the pin and the inner wall of the socket, with the pin exerting radial pressure against the socket in a plane transverse to the direction of the axial force producing the engagement therebetween. This constitutes a very inefficient mode of force transfer. Thus, even when an adequate axial force is applied to the pin, there can result an inadequate mechanical pressure contact between the pin and the socket. A poor pressure contact between a pin and its socket may cause undesirable attenuation of the signal carried by the electric conductors connected thereto, or even a complete loss of signal.

The design of conventional plugs for use as spread connectors requires that their contacts be precision manufactured and accurately aligned both in the vertical and horizontal directions relative to the plug's end face. Such precision machining and assembly makes the cost of manufacturing conventional spread connectors relatively high. When a conventional spread connector requires servicing either because its contacts are dirty or because some of its contacts break or become misaligned, such service can frequently not be accomplished in the field.

Other problems associated with conventional spread connectors are caused by their geometric configurations which makes them objectionable for use with seismic spread cables. Some such spread connectors even have latching problems associated with the exposed means used to secure together the two plugs of the connector. The above-mentioned problems are aggravated by the fact that seismic field crews are frequently composed of relatively inexperienced personnel at least as far as being able to locate a problem associated with a spread connector and make the required repairs thereto.

SUMMARY OF THE INVENTION

The multi-contact connector of this invention is particularly adapted for seismic use in coupling geophone spread cables. The connector is characterized, in general, by contacts which are unbiased, that is which are neither male nor female, since all contacts of the connector are preferably identical in shape and of the same material. Each contact has a prong-end any portion of which is exposed and can be easily cleaned. The intercontact pressure is exerted in the same direction as the force required to move the plugs into mating engagement. Each pair of engaged prong-ends establishes a self-cleaning mechanical pressure contact which is continuously maintained by the connector's latching means securing the plugs to each other.

Each prong-end is preferably resiliently mounted to provide some tolerance for misalignment of the prong ends in the axial direction of the contacts. Each prong-end preferably has a flat rectangular contact surface with a length-to-width ratio greater than 1 and preferably between 5 and 10. The prong-ends are disposed on the opposed end faces of the plugs such that their engaging contact surfaces intersect substantially at right angles to each other. Therefore, the width of one contact surface has sufficient mechanical tolerance to engage any portion of the length of its mating contact surface whereby electric contact is maintained even when the mating prong-ends are misaligned relative to a contact's bisecting plane. Accordingly, the design of the spread connector of this invention requires no expensive tooling compared to the cost of the tooling required to make conventional spread connectors.

Other features, objects, and advantages of the present invention will become apparent from the following description taken in conjunction with the accompanying drawings.

Figures 1, 2, 3, 4, 5, 6, 7, 8, 9, 10, 11:
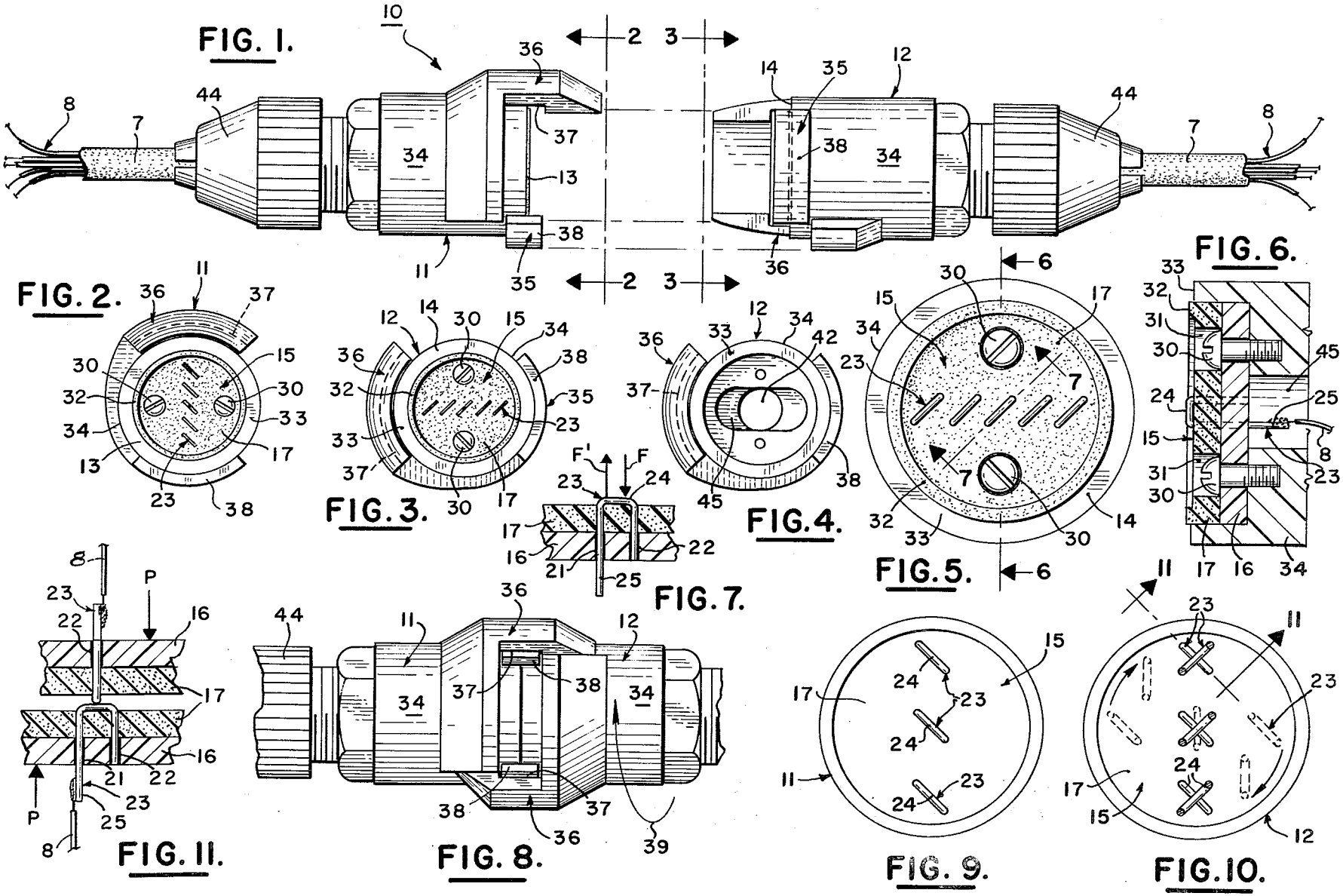
FIG. 1 is a view in elevation of one type of spread connector in accordance with the invention.
FIGS. 2 and 3 are end views on lines 2—2 and 3—3 in FIG. 1, respectively.
FIG. 4 is similar to FIG. 2 with the contact base removed.
FIG. 5 is a front view of the contact base.
FIGS. 6 and 7 are sectional views on lines 6—6 and 7—7 in FIG. 5, respectively.
FIG. 8 is a front view of the latching means for the connector housing shown in FIG. 1.
FIGS. 9 and 10 illustrate the relative positions of the prongends during rotation of one plug relative to the other plug.
FIG. 11 is a partial sectional view showing a pair of engaged contacts and their supporting bases.

In the drawings, for ease of illustration the same reference characters will be used to designate the same or similar parts. The embodiment of the multi-contact connector, shown in FIGS. 1–11, is generally designated as 10. The connector is adapted for interconnecting a pair of geophone spread cables 7, each having a plurality of insulated conductors 8. Connector 10 comprises a pair of plugs 11, 12 having opposite end faces 13–14, respectively. Plugs 11 and 12 have contact bases 15 which are identical in all respects.

Figures 12, 13, 14, 15, 16, 17, 18, 18A:
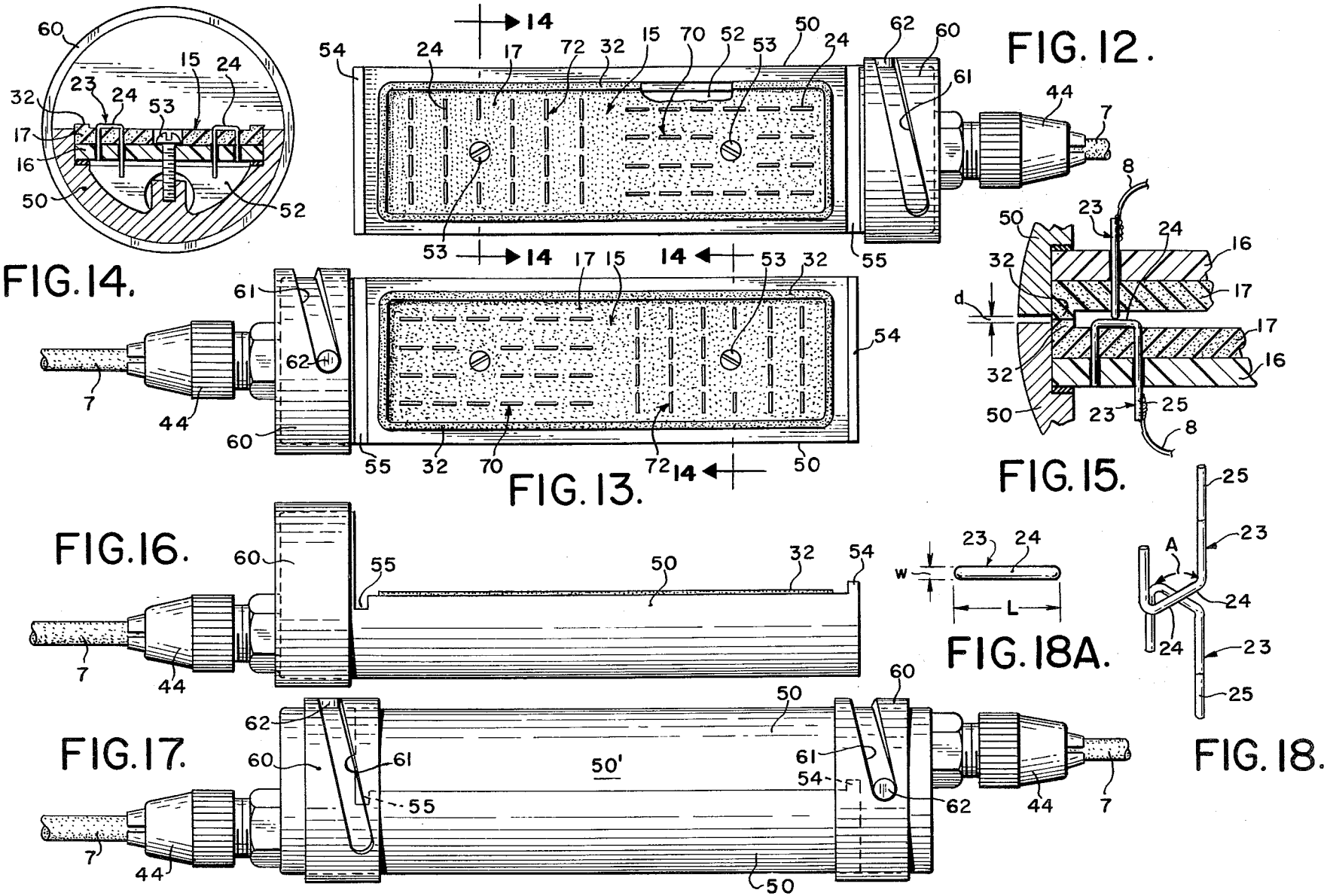
FIGS. 12 and 13 are plan views of two mating plugs of another embodiment of the spread connector of this invention, each plug having two groups of contacts perpendicular to each other.
FIG. 14 is a view on lines 14—14 in FIGS. 12 and 13.
FIG. 15 is a partial sectional view of the opposed bases containing one pair of engaging contacts.
FIG. 16 is a front view of the plug shown in FIG. 13.
FIG. 17 is a front view of the assembled connector formed by the engagement of the plugs shown in FIGS. 12 and 13.
FIG. 18 shows a pair of engaging contacts.
FIG. 18A illustrates the length-to-width ratio of the prong-end surface.

Each base has a hard insulating plate 16 made of bakelite, secured to an overlying insulating and resilient plate 17 made of rubber or the like. A plurality of pairs of transverse holes 21, 22 (FIG. 7) are provided in each contact base 15. A plurality (equal to the number of pairs of holes) of connector contacts 23 are provided, each contact being made of a good conducting metal. Each contact can assume various configurations. In the embodiments illustrated, the contacts are made out of rod-like material and each is U-shaped. One leg of contact 23 is longer than the other and serves as a contact terminal 25 projecting outwardly of plate 16 for connection to a conductor 8 as by soldering. The base portion of the U-shaped contact projecting outwardly of and lying over the resilient plate 17 forms the engaging prong-end 24 of the contact. Prong-end 24 has a rectangular projection in a plan view (FIG. 18A). Its width dimension $w$ is desirably considerably smaller than the length dimension $l$ so that the ratio $l/w$ is greater than one and in the preferred embodiment is between 5 and 10.

The engaging prong-ends 24 of the contacts intersect upon mating engagement at an angle A (FIG. 18) which is preferably 90°. In this manner, as long as the width of one prong-end is positioned over and engages any portion of the length of the opposite mating prong-end, good mechanical and electrical continuity will be maintained therebetween. With a length-to-width ratio on the order of 5 to 10, even with liberal tolerances the prong-ends will practically always engage. Since both the machining and assembly of the connector can accept more liberal tolerances, the connectors of this invention can be manufactured at a substantial reduction in cost.

Each of holes 21, 22 has a diameter slightly larger than the diameter of the rod like material from which each contact 23 is made. Therefore, each contact can move in a downwardly vertical direction, as viewed in FIG. 7, in response to an axial load F if this load is greater than the counter force F′ produced by the resilient plate 17. Thus, if some of the prong-ends 24 are not prefectly aligned in a plane parallel to end faces 13, 14 of plugs 11, 12, such misalignment will be automatically compensated for by the resilient plate 17.

Since the exposed surfaces of the prong-ends 24 are convex they are easy to clean. Moreover, when the two plugs 11, 12 are moved toward each other for mating engagement and the connector 10 becomes latched, as will be subsequently described, there is a continuous latching pressure P (FIG. 11) exerted by the prong-ends on each other which serves to break away any film of dust or other foreign matter which may be deposed on the prong-ends. In this respect, it may be said that the prong-ends are self-cleaning which amounts to a considerable advantage over biased contacts, such as pins and sockets, or other conventional connector contacts, wherein the latching pressure is in one direction and the inter-contact pressure is in a transverse direction.

In the embodiment shown in FIG. 1, each contact base 15 has a cylindrical configuration and is secured to the housing 34 of each plug by a pair of screws 30 (FIG. 6) each screw fitting inside a recess 31. Plate 17 of each base 15 has an annular, outwardly extending shoulder 32 which projects outwardly of the annular end face 33 of housing 34.

The two housings 34 of plugs 11, 12 are each provided with latching means formed by a male part 35 and a mating female part 36. The male part 35 has an inner annular groove 37 adapted to receive therein an annular shoulder segment 38. To bring about the engagement between plugs 11 and 12 and thereby to effect the mating engagement between pairs of contacts 23 plugs 11 and 12 are first aligned as shown in FIG. 1 and then forcibly moved toward each other in the longitudinal direction. The coupling is completed when shoulder 38 moves into its mating groove 37 which is brought about by, for example, rotating plug 12 in a clockwise direction 39 (FIG. 8) by an angle of about 90° which corresponds to the angle sustained by shoulder 38. Such rotation effectively locks the plugs together and compresses the resilient shoulders 32 thereby sealing off the space occupied by the prong-ends 24.

The contacts 23 are disposed in their respective bases 15 such that when end face 14 together with is contacts 23 rotates relative to end face 13 in the direction 39 (FIGS. 8–10), the prong-ends 24 wil come to rest when in mating interengagement, as shown by the solid lines. The dotted lines represent the transit positions of the prong-ends. Upon engagement the planes of the contacts will then intersect and form a substantial angle A therebetween (FIG. 18) of say approximately 90°. From FIG. 10 it will also be noted that any displacement of one prong-end 24 relative to its mating prong-end, as a result of accident or abuse, will still not produce a lack of continuity between the contacts' terminals 25, unless such displacement is excessive, as when a prong-end is completely bent out of shape.

Each cable 7 enters its plug through an opening 42 (FIG. 4) and the cable is secured to the plug by a conventional split sleeve chuck 44. The electric conductors 8 and the contacts' terminal ends 25 (FIG. 6) are lodged inside a channel 45 (FIG. 6) in the plug's housing.

The two embodiments of the connector shown in FIGS. 1 and 17 are similar to each other in most important respects except for the arrangement of the contacts, the geometry of the contact bases, and their supporting housings. The following description will therefore be limited only to their distinguishing features.

Each plug housing is generally semi-cylindrical and defines an inner cavity 52 adapted to accept the contact base 15 therein which is secured thereto by screw 53. Cavity 52 preferably has a length-to-width ratio greater than one. An outwardly extending shoulder 54 (FIG. 16) of one plug is adapted to be received by a mating recess 55 in the opposite plug housing. Each base 15 (FIG. 14) has a peripheral, outwardly-extending edge 32 which becomes compressed to seal off the space occupied by the prong-ends 24 when the two plugs are forcibly interengaged. Shoulders 32 form an initial separation $d$ (FIG. 15) between the mating housings.

The latching means comprise a rotatably mounted sleeve 60 having an inclined recess 61 housing a radially extending pin 62. Sleeve 60 can move in an axial direction by an amount determined by the length of the inclined slot 61. In FIGS. 12 and 13, sleeves 60 are shown at their respective outer positions wherein they allow the engagement of the semi-cylindrical plugs 50. When plugs 50 are forcibly moved toward each other, the separation *d* between the resilient edges 32 vanishes, allowing cylindrical sleeves 60 to slide toward each other until their innermost latching positions (FIG. 17) whereat the cylindrical connector 50' is locked.

It will be appreciated by those skilled in the art that the construction of connector 50' lends itself for use with geophone spread cables in that the diameter of connector 50' is relatively small compared to its length dimension and that the latching means employed do not appreciably spread out from the housing to become vulnerable to abuse, as is the case with many conventional multi-contact spread connectors.

To allow each end of the geophone spread cable to become coupled to each other end, one half of the electric conductors 8 in each cable are connected to a first group of contacts, generally designated as 70 (FIG. 12), and the other half of the electric conductors is connected to another group of contacts, generally designated as 72. The contacts of groups 70, 72 lie in mutually perpendicular planes. Upon full engagement of plugs 11, 12, each pair of mating contacts will be intersecting each other as shown in FIGS. 15, 18.

While this invention has been illustrated with respect to specific embodiments thereof, it will be appreciated by those skilled in the art that modifications may be made therein without departing from the scope of the claims attached hereto.

What is claimed is:

1. A two-plug connector for detachably connecting together two lengths of a multiple conductor cable, each connector plug comprising:

an insulating base, a protective housing supporting said base;

a support covering said base, said support being made of a flexible, insulating material of sufficient resiliency to tend to reassume its original form after deformation;

a plurality of U-shaped contacts, each contact having an elongated prong-end and a pair of prongs forming integral part with and extending from each prong-end, one prong of each pair of prongs being adapted for connected to a cable conductor, each prong-end lying on and being resiliently supported by the upper surface of said support, and each prong-end being urged axially away from the upper surface of said support;

a plurality of pairs of aligned holes transversely extending through said support and said base, each pair of contact prongs being slidably received by a corresponding pair of said aligned holes, whereby said support makes a water tight joint with each prong, and each prong-end is removable by pulling axially thereon away from the upper surface of said support; and the housing of one connector plug being adapted to form a mechanical attachment with the protective housing of the other connector plug to thereby mechanically and electrically engage the respective prong-ends of both connector plugs at an angle relative to each other.

2. The connector of claim 1, wherein each contact is made of rod-like metal, and said angle is approximately 90°.

* * * * *